US006561221B1

(12) United States Patent
Kurz

(10) Patent No.: US 6,561,221 B1
(45) Date of Patent: May 13, 2003

(54) CONTROL ARRANGEMENT FOR A WORKING CYLINDER

(75) Inventor: Manfred Kurz, Altenstadt (DE)

(73) Assignee: Hoerbiger Hydraulik GmbH, Schongau (DE)

( * ) Notice: Subject to any disclaimer, the term of this patent is extended or adjusted under 35 U.S.C. 154(b) by 0 days.

(21) Appl. No.: 09/525,915

(22) Filed: Mar. 15, 2000

(30) Foreign Application Priority Data

Mar. 18, 1999 (AT) ..... 188/99 U

(51) Int. Cl.[7] ..... F15B 13/044

(52) U.S. Cl. ..... 137/596.17; 137/637; 251/900

(58) Field of Search ..... 137/596.15, 596.16, 137/596.17, 625.64, 625.65, 625.66, 637, 637.1; 251/30.01, 30.02, 30.05, 129.1, 129.08, 900; 91/433, 459, 461

(56) References Cited

U.S. PATENT DOCUMENTS

| | | | | | |
|---|---|---|---|---|---|
| 2,404,349 | A | * | 7/1946 | Brant | 137/625.65 |
| 2,600,746 | A | * | 6/1952 | Ernst | 137/625.65 |
| 2,619,121 | A | * | 11/1952 | Renick | 137/625.65 |
| 3,060,969 | A | * | 10/1962 | Aslan | 251/30.05 |
| 3,254,675 | A | * | 6/1966 | Johnson | 137/625.65 |
| 3,618,690 | A | * | 11/1971 | Johnson | 251/900 |
| 4,220,174 | A | * | 9/1980 | Spitz | 137/625.65 |
| 4,422,475 | A | * | 12/1983 | Aspinwall | 137/625.65 |
| 4,456,434 | A | * | 6/1984 | El Ibiary | 137/625.65 |
| 4,457,341 | A | * | 7/1984 | Aspinwall | 251/129.08 |
| 4,513,653 | A | | 4/1985 | Varlemann | 137/624.27 |
| 4,565,219 | A | * | 1/1986 | Kunogi | 137/625.65 |
| 4,616,675 | A | * | 10/1986 | Amrhein | 137/625.65 |
| 4,617,967 | A | * | 10/1986 | Read et al. | 137/596.17 |
| 4,643,225 | A | * | 2/1987 | Imhof | 137/596.17 |
| 4,754,780 | A | * | 7/1988 | Smith, III | 251/900 |
| 4,821,773 | A | * | 4/1989 | Herion et al. | 137/625.65 |
| 4,860,792 | A | * | 8/1989 | Ichihashi et al. | 137/596.17 |
| 5,058,484 | A | | 10/1991 | Kuttruf | 91/461 |
| 5,284,220 | A | * | 2/1994 | Shimizu | 137/625.65 |
| 5,385,171 | A | * | 1/1995 | Cleasby | 137/596.17 |
| 5,487,404 | A | * | 1/1996 | Kerger | 251/900 |
| 5,606,993 | A | | 3/1997 | Stoll | 137/596.18 |

FOREIGN PATENT DOCUMENTS

| | | | | |
|---|---|---|---|---|
| DE | 3346235 | | 7/1984 | |
| EP | WO 94/21947 | * | 9/1994 | 137/625.65 |
| EP | 0 686 775 | | 12/1995 | |
| EP | 0654608 | | 7/1997 | |

OTHER PUBLICATIONS

E. Westkämper et al., "Mehrgrössenregelung hydraulischer Antriebe–Potentiale für Handhabungsgeräte" in Ölhydraulik und Pneumatik, 42 (1998) No. 4, p. 240.

* cited by examiner

*Primary Examiner*—George L. Walton
(74) *Attorney, Agent, or Firm*—Dykema Gossett PLLC

(57) ABSTRACT

In a control arrangement for a working cylinder (1), which may be actuated by a pressure medium, there are provided two separate adjustable regulating valves (4, 5) for both sides of the cylinders, each connected with a pressure medium outlet (t) on one side and with the working cylinder (1) on the other side. The adjustment elements (4', 5') of the two regulating valves (4, 5) are housed in a common valve housing (31) for simplification of production, connection, assembly and maintenance; whereby the valve housing is provided with pressure medium connections for both cylinder sides that are to be controlled and with the corresponding conduits.

5 Claims, 3 Drawing Sheets

CONTROL ARRANGEMENT FOR A WORKING CYLINDER

BACKGROUND OF THE INVENTION

1. Field of the Invention

The invention relates to a control arrangement for a working cylinder that may be actuated by a pressure medium having two separate adjustable regulating valves for both cylinder sides whereby each regulating valve is connected to a pressure medium source and a pressure medium outlet on one side and to the working cylinder on the other side.

2. The Prior Art

Traditionally, 4/3-port directional control valves (servo or proportional) are used for the control of double-action pressure medium motors or working cylinders and with which valves the user connections leading to both cylinder sides, the pressure medium connection and the tank or pressure medium outlet connection are all controlled together. The four controlling bevels necessary for the control are disposed rigidly on a common adjustment device, for example a piston-type control slide valve, whereby it is achieved, for example, in a simple manner that during application of pressure on one side of the cylinder, the respective other cylinder is correspondingly exhausted or connected to a tank.

Since this rigid coupling of the control of the two cylinder sides causes a number of difficulties, for instance during the control of differential cylinders as a result of different volumes at the two cylinder sides, whereas these difficulties may be avoided only with additional measures (for example by using so-called post suction valves.) A great deal to be desired are also the stiffness under load, precision in positioning and quiet operation at various loads and velocities as a result of pressure shocks, decompression impacts or the like. It has been already suggested, for example in "*Ölhydraulik und Pneumatik* (Oil Hydraulics and Pneumatics) 42 (1998) No. 4, page 240 and following pages, that the common 4/3-port directional control valves at both sides of the cylinder are to be replaced with two separate 3/3-port directional control valves for each cylinder side, which may be driven separately and independently from one another and which allows a great number of new possibilities for regulating cylinders. Stiffness under load for the drive may be increased according to need without problems, which results in an improvement for precision in positioning and quiet operation under various loads and velocities and which has as a result that the effects of the pressure shocks and decompression impacts are greatly reduced.

A similar control arrangement is further known from EP 654 608 B1, for example, in conjunction with a piston-less pneumatic cylinder, whereby the separate drive potential for each side of the cylinder is utilized to make possible a more efficient braking of the piston or thereby possible increase of the adjustment speed.

A disadvantage with the known embodiments of control arrangements of the noted type is of course the high demand for individual components and thereby also additional connection lines and the like, which requires also an increased effort in assembly and maintenance.

It is the object of the present invention to improve the control arrangement of the noted type in such a manner that the discussed disadvantages of the known embodiments are avoided and whereby especially the need of individual components to be assembled and to be connected is reduced and whereby a better layout of the control arrangement and simplified assembly and maintenance will be achieved.

SUMMARY OF THE INVENTION

This object is achieved according to the present invention with a control arrangement of the type mentioned above in that the adjustment elements of the two regulating valves are housed together in a common valve housing, which is further provided with pressure medium connections that are to be controlled for both sides of the cylinder and which in turn are provided with controlling bevels that communicate with the adjustment elements and which cylinder sides also have conduits which connect the control chambers. Thereby there is now, in an advantageous manner, a single compact unit employed again for the control of both sides of the cylinder, which is generally designed in the same manner, in regard to arrangement, the connections, assembly and maintenance, as the common 4/3-port directional control valve with rigid coupling for the control of the two cylinder sides mentioned above. The outwardly detectable and substantial differences of the novel embodiment are the separate adjustment possibilities of the two adjustment elements, which ensures the described functional division of the drive for the two sides of the cylinder. The required conduits and connections are arranged in or on the common valve housing, which naturally simplifies assembly and maintenance and which reduces possible faults or breakdowns. Given a corresponding arrangement of connections in the valve housing, the novel control arrangement can be used also very simply in the present application instead of the above-mentioned arrangement with a 4/3-port directional control valve—only provisions have to be made for the separate actuation of the two adjustment elements inside the common valve housing.

In a further embodiment of the invention it is proposed that the two adjustment elements are designed as adjustment pistons, which are disposed coaxial in the valve housing and which are adjustable by separate regulating drives being located opposite to one another at the outer frontal sides. This results in a structural simple configuration of the valve housing and in easy access to the two separate regulating drives and which also improves or simplifies assembly and maintenance.

In a further preferred embodiment of the invention, each adjustment piston may be guided within a control sleeve, which preferably holds both pistons and which can be arranged in the valve housing. This makes possible separate manufacturing of the sleeve from super hardened material—which communicates with the controlling bevels of the adjustment piston—or which also makes possible simple replacement of this sleeve after (excessive) wear.

In an additional preferred embodiment of the invention it is proposed that in order to counteract the negative effects of the uncontrollable pressure buildup caused by the pressure medium flowing into the outer frontal chambers after reaching the regulating drives through the guide clearance of the adjustment pistons, the outer frontal chambers on the regulating drives are connected with one another via axial bores in the adjustment pistons and via a servo-valve with the pressure medium outlet. In traditional directional control valves, the outer chamber on the regulating drives are often directly connected with the tank connections or via a throttle with a pressure connection and via a second throttle with the tank connection. The first configuration has the disadvantage of poor exhaust for the frontal chambers facing the regulating drives and development of pressure peaks, which could lead to instabilities in regulating; whereby in the second mentioned configuration a loss of power occurs additionally with its large throttle cross sections, whereas in case of small throttle cross sections the risk of activating the throttle exists and thereby an uncontrollable pressure buildup occurs in these chambers, which in turn may lead to the destruction of the regulating drive, which is normally not capable of bearing the maximum operational pressure. These disadvantages are avoided with the present embodiment of the invention and constant pressure is guaranteed in the frontal chambers on the regulating drives without additional loss of power.

Especially advantageous, within the above-mentioned context, is a yet further embodiment of the invention wherein the control sleeve between the two adjustment pistons are in an open position, preferably separated, and whereby the servo-valve is designed as an elastic sealing ring pre-stressed from the outside in radial direction over the opening, preferably over the ends of the two control sleeve segments. Naturally, besides the also known possibility, a traditional servo-valve designed as a spring-loaded ball valve may be provided in a conduit leading to the pressure medium outlet or the tank, for example. Furthermore, a structurally simple configuration can be realized with the described embodiment together with an open or separated control sleeve, whereby the achieved nearly constant pressure level leads to a high regulating stability in the chambers on the regulating drives without additional leakage (of pressure medium.)

The invention will be better understood by reference to the attached drawings and the following discussion.

DETAILED DESCRIPTION OF THE PREFERRED EMBODIMENTS

Figure 1:
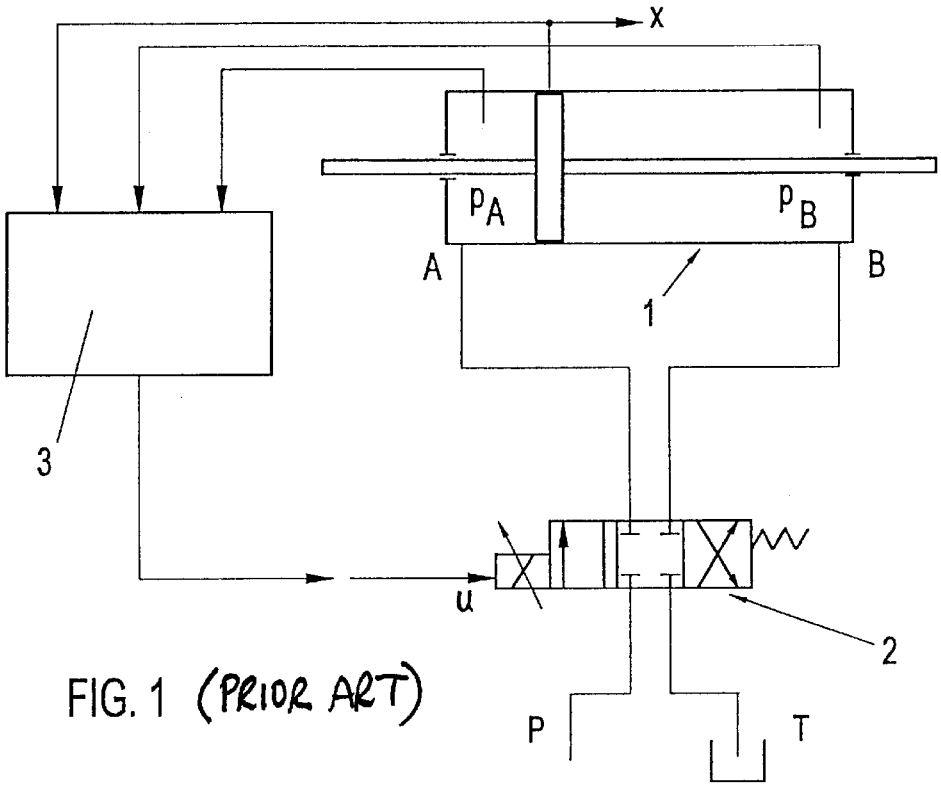
FIG. 1 (PRIOR ART)
FIGS. 1 and 2 show a schematic connection diagram of control arrangements for working cylinders actuated by a pressure medium according to the state-of-the-art, and FIGS. 3 and 4 respectively depict various embodiments of control arrangements according to the present invention in a partial, longitudinal cross-sectional view.

According to FIG. 1, a working cylinder 1 actuated by a pressure medium is controlled in a traditional manner by means of a 4/3-port directional control valve 2, which is connected on one side with the two working chambers of the working cylinder 1 via the connections A and B, and on the other side with a pressure medium source via the connection P and it is also connected via the connection T to a pressure medium outlet to the tank. The directional control valve 2, which is spring-loaded on one side, is actuated on the other side with an electromagnet, for example, whereby the power supply (indicated by "u") for the electromagnet is provided from the control unit 3, which receives as entry values sensor signals corresponding to the pressures $P_A$ and $P_B$ as well as the piston stroke "x".

This simple control arrangement traditionally used for drives of this type makes essentially possible, as a result of the rigid coupling of the pressure medium drive of both cylinder sides, a precise and diametrically opposed operation of the two cylinder chambers—at pressure application to one side, the other side is inevitably reduced in pressure, or vice versa, toward the connection T. Thereby disadvantages occur, as already mentioned, in regard to insufficient stiffness under load, pressure shock sensitivity and the like, for example. Additional problems occur with this control arrangement also then, for example, when the piston rod of the working cylinder 1 protrudes only to one side, in contrast to the illustration in FIG. 1, and in this way (or any other way) a considerably difference of exchanging volume occurs in both sides of the piston.

Figure 2:
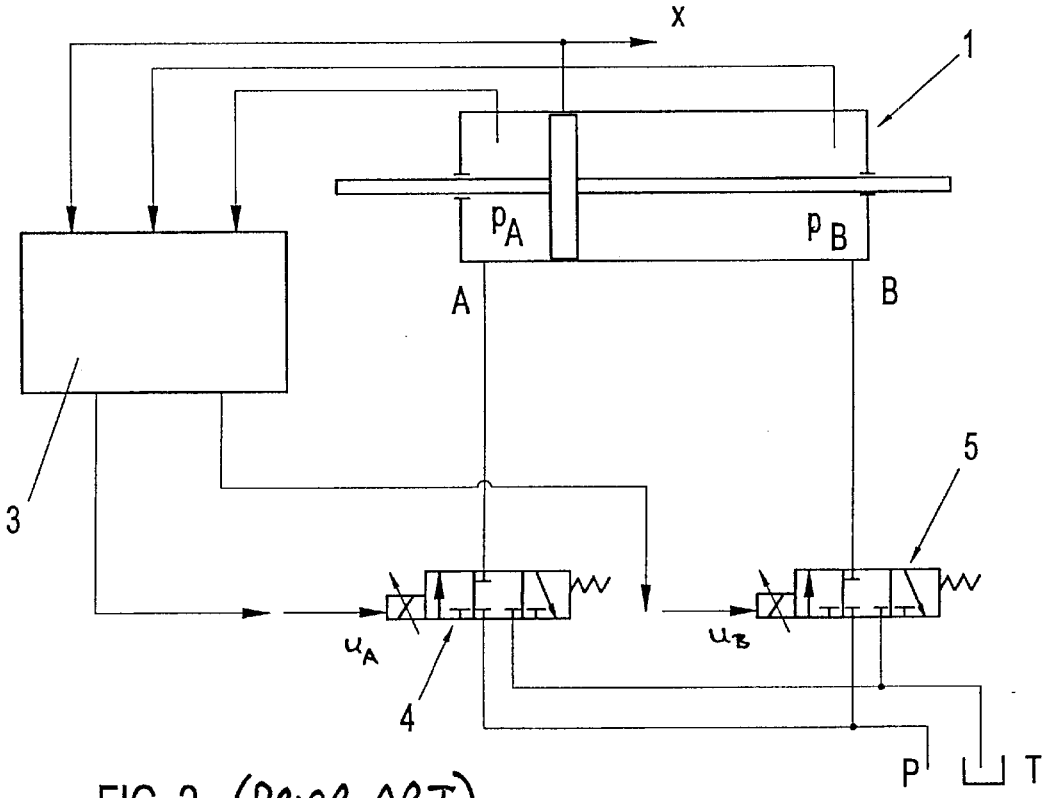
FIG. 2 (PRIOR ART)

According to FIG. 2, the common 4/3-port direction control valve 2 of both cylinder sides in FIG. 1 is now replaced with two, independent from one another, adjustable 3/3-port directional control valves 4 and 5 (drives $u_A$ and $u_B$), whereby there is achieved in a very simple and effective fashion the possibility of a pressurization that is independent from one another, or blocking, or pressure decrease in both chambers, which in turn can be utilized, for example, to increase the stiffness under load or also to improve positioning precision or to achieve a more quiet operation at various loads and velocities. In addition it can be utilized for reduction of the negative effects from volume differences as well as from pressure shocks and decompression impacts.

Figure 3:
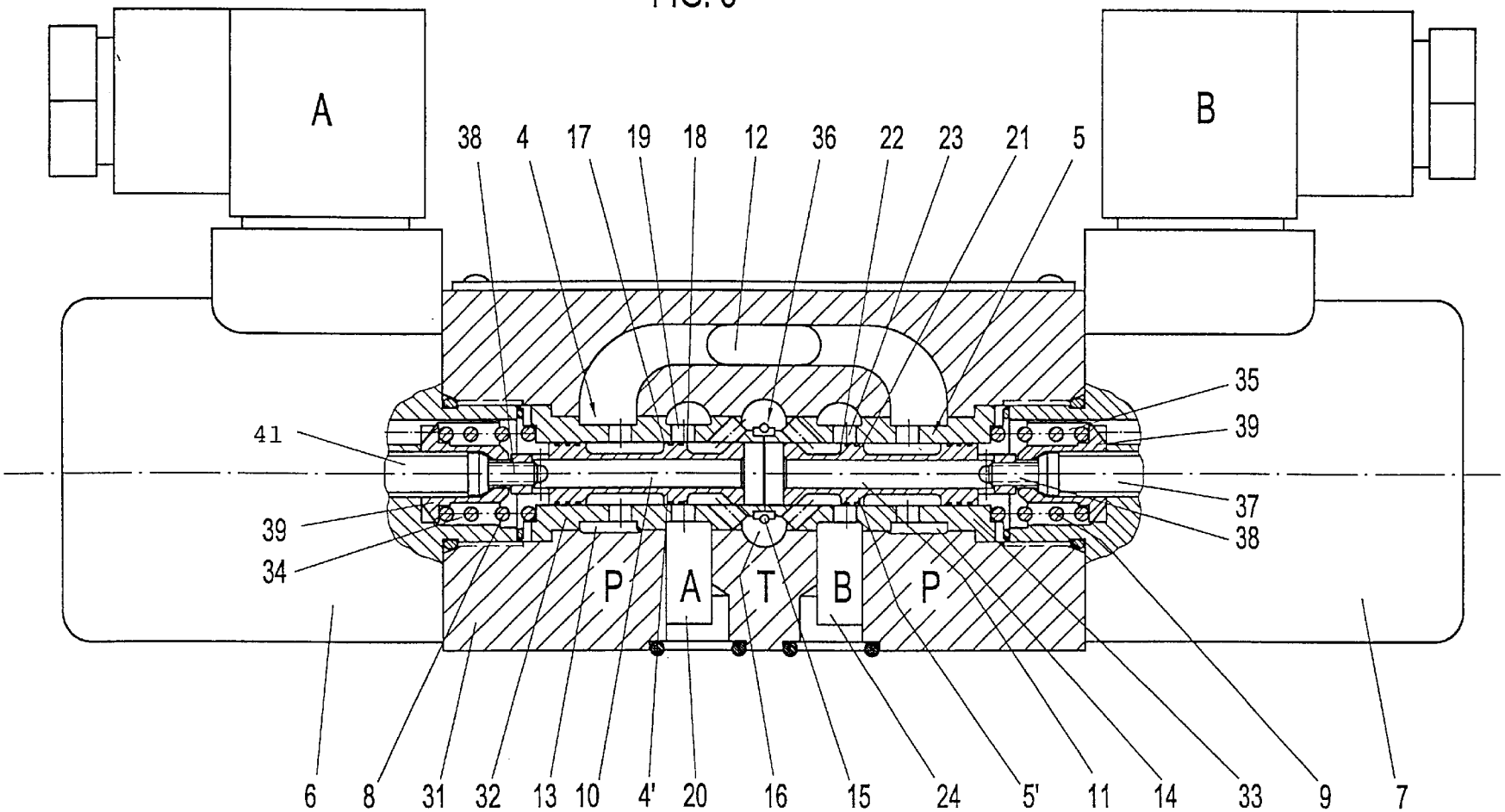

In the embodiment according to the invention in FIG. 3 there are now the two separate adjustable regulating valves 4 and 5, which are connected each with the pressure medium source P and the pressure medium outlet T on one side and on the other side with the working cylinder (via A and B), designed in such a manner that their adjustment elements 4' and 5' are disposed in a common valve housing 31, which is also provided with the to-be-controlled pressure medium connections for both cylinder sides. The valve housing is further provided with conduits connecting the control chambers whereby the conduits communicate with the adjustment element 4' and 5' and the control edges or bevels 17 and 18 on one side and 21 and 22 on the other side thereof.

The two adjustment elements 4' and 5' are designed as adjustment pistons that are arranged coaxial in the valve housing 31 and are adjustable by separate regulating drives 6 and 71 which are located opposite to one another at the outer frontal sides. Each adjustment piston 4',5' is guided within a control sleeve which is separated between the two adjustment pistons 4' and 5' in two parts 32,33 within the valve housing 31 which makes possible simple construction and manufacturing of the valve housing 31. The outer frontal chambers (pressure chambers) 34 and 35 on the regulating drives 6 and 7 are connected with one another by axial bores 10 and 11 in the control pistons 4' and 5' and are further connected with the pressure medium outlet T via a pressure-limiting valve 36 disposed in the center. This pressure-limiting valve 36 is realized here as an elastic sealing ring 15, which is pre-stressed from the outside in radial direction over the ends of the two control sleeve segments 23 and 33.

The two regulating drives 6 and 7 are designed as electric proportional magnets, for example, which operate the adjustment pistons 4' and 5' with corresponding electrical drive via the anchor extensions 41 and 37 and adjustment screws 38—in the other movement direction, springs 8 and 9 are employed, which are braced on one side against the control sleeve segments 32, 33 and on the other side against the transfer bushings 39 and by which springs the anchor extensions 41, 37 are pushed back again, carrying along the adjustment piston 4' and 5'.

The pressure medium, which reaches the pressure chambers 34 and 35 through the guide clearance of the adjustment piston 4' and 5' during the operation of the arrangement, causes an increase in pressure, which in turn compresses the existing air therein. When a certain pressure level is reached, then the elastic ring 15 opens the gap between the two control sleeve segments 32 and 33 to the tank connection chamber 16, whereby a nearly constant pressure level is achieved in the pressure chambers 34,35, which in turn leads to a high regulating stability without additional leakage (of pressure medium).

It is easy to see that the entire arrangement in FIG. 3 is built very small and compact and corresponds to the conventional solution according to FIG. 1 in light of the connections there is only a second actuating device required to realize all functions described in FIG. 2.

The pressure connection P of the directional control valve in FIG. 3 is divided by the bypass channel 12 in the valve housing 31 and leads to the pressure connection 13 of the control sleeve segment 32 or the pressure connection 14 of the control sleeve segment 33. The user chamber 20 (connection A) is connectable with the pressure connection 13 or the tank connection 16 via the controlling bevels 17 and 18 on the adjustment piston 4' and the radial openings 19 on the control sleeve 32.

The user connection 20 (A) is connected with the tank connection 16 in the illustrated powerless basic position of the proportional magnet in the actuating drive. When electric power is applied to the actuating drive 6, then the adjustment piston 4' is pushed to the right, whereby the circuit from the user connection 20 (A) to the tank connection 16 is closed and a conduit from the pressure connection 13 to the user connection 20 (A) is established.

On the other side, the user chamber 24 (connection B) is connectable with the pressure connection 14 or the tank connection via the controlling bevels 21 and 22 on the adjustment piston 5' and the radial opening 23. Any further function description corresponds to the above function description of the regulating valve 4.

Figure 4:
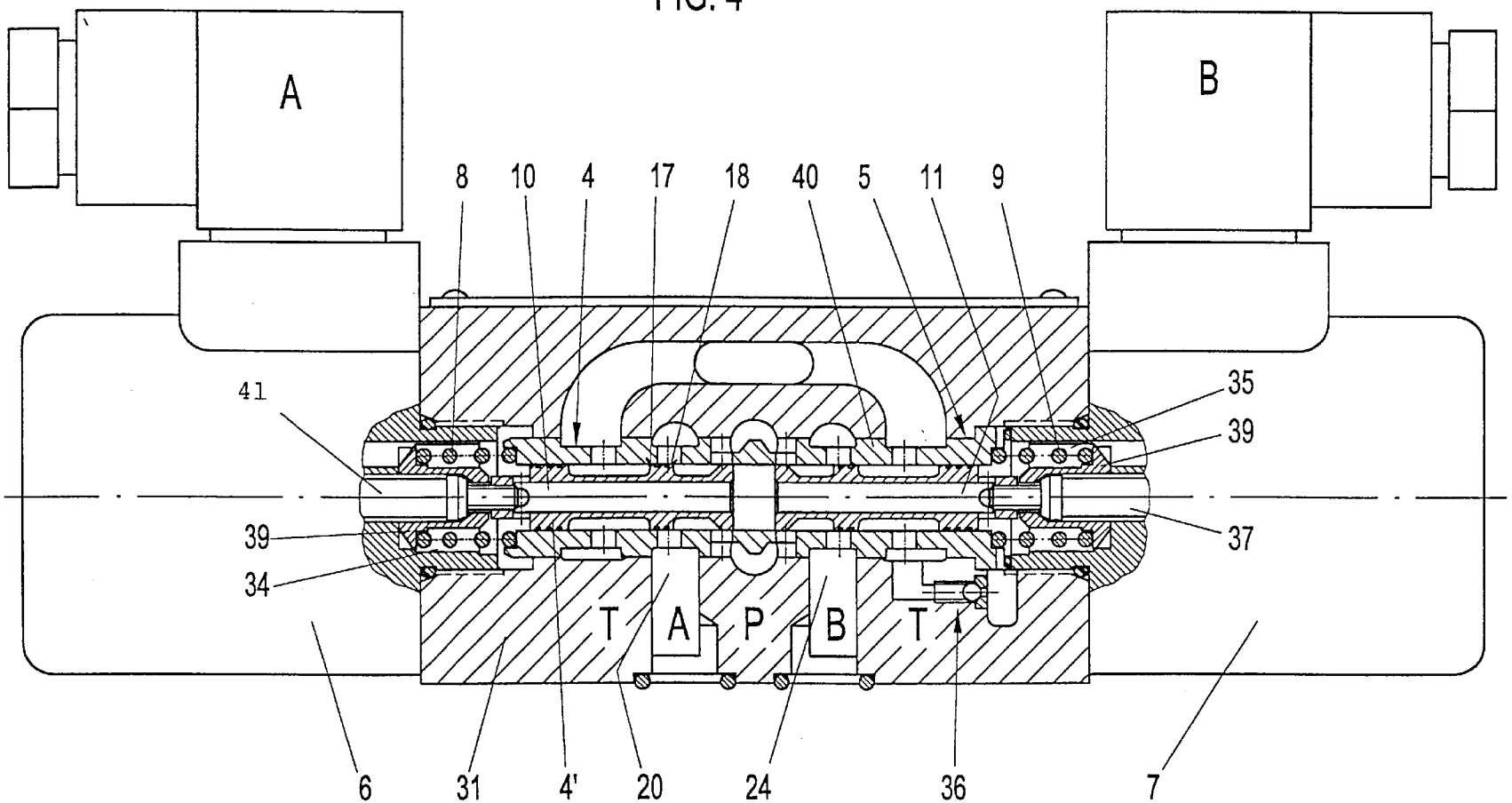

In FIG. 4 there is shown as a modification to FIG. 3 a control sleeve 40 for both adjustment pistons 4' and 5' designed as one-piece and not separated and which is inserted from the right into the common valve housing 1. The pressure medium connections have been changed compared to the embodiment in FIG. 3 in that here the connection of the pressure medium source P is disposed in the center and the connections to the pressure medium outlet T are each disposed on the outside. The control function of the arrangement or the possibility for separate control of both user connections A, B remains unchanged in comparison with FIG. 3.

The frontal anchor (pressure) chambers 34,35 are here again connected with one another via center bores 10 and 11 in the adjustment pistons 4' and 5', but whereby only one spring-loaded ball valve is employed as a pressure-limiting valve 36 in a connection of the right anchor chamber 34 to the pressure medium outlet T. Furthermore, it can be guaranteed advantageously that uncontrollable pressure buildup and associated breakdowns or damages may not occur in the pressure chambers 34 and 35.

I claim:

1. A control device for separately and independently controlling two flows of pressure medium to a working cylinder, said control device comprising:

a housing which defines first and second opposite ends, a passageway therethrough, first and second pressure medium inlet connections, first and second pressure medium outlet connections, a pressure medium discharge connection, and a first and second pressure chambers located at said opposite ends, first and second independently movable adjustment elements which are located in said passageway and always define a gap therebetween to assure independent movement thereof, there being no mechanical means attaching said first and second adjustment elements together across said gap, said first and second adjustment elements defining fluid passageways therethrough to communicate said respective first and second pressure chambers with each other and a prestressed check valve for controlling pressure medium flow from said first and second pressure medium chambers to said pressure discharge connection, said first and second pressure chambers becoming pressurized with pressure medium leaking past said respective first and second adjustment elements, each of said first and second adjustment elements defining two control edges which respectively and independently control flow of medium inlet connections to said first and second pressure medium inlet connections to said first and second pressure medium outlet connections depending on independent axial positioning thereof within said housing, and first and second drive means at said first and second ends of said housing respectively connected to said first and second adjustment elements to control movement thereof within said housing independently of one another.

2. A control device according to claim 1, wherein said first and second adjustment elements respectively comprise first and second pistons.

3. A control device according to claim 2, wherein said first and second pistons are coaxially positioned within said housing and define axial bores therethrough which enable pressure medium to flow from said first and second pressure chambers to said pressure medium discharge connection.

4. A control device according to claim 3, including a control sleeve located within said housing between said first and second pistons and an interior wall of said housing.

5. A control device according to claim 4, wherein said control sleeve comprises separated first and second sleeve parts which are respectively positioned between said first and second pistons and said interior wall of said housing, and wherein said valve comprises a prestressed elastic sealing ring positioned around a gap defined between adjacent ends of said first and second sleeve parts, said elastic sealing ring being movable to open said opening with sufficient fluid medium pressure applied thereto through said axial bores so as to enable pressure medium flow to said discharge connection.

* * * * *